United States Patent [19]

Giacobbe

[11] 4,166,799

[45] Sep. 4, 1979

[54] APPARATUS FORMATION OF GASEOUS MIXTURES AND METHOD OF USE

[75] Inventor: Frederick Giacobbe, Hanover, Pa.

[73] Assignee: Chemetron Corporation, Chicago, Ill.

[21] Appl. No.: 847,208

[22] Filed: Oct. 31, 1977

[51] Int. Cl.[2] ..... B22C 1/22; B22C 9/12

[52] U.S. Cl. ..... 252/182; 55/89; 55/90; 164/43

[58] Field of Search ..... 252/182; 164/43; 55/89, 55/90

[56] References Cited

U.S. PATENT DOCUMENTS

| | | | |
|---|---|---|---|
| 3,439,475 | 4/1969 | Austin et al. | 55/90 |
| 3,795,726 | 3/1974 | Zifferer et al. | 164/43 |
| 4,051,886 | 4/1977 | Ross | 164/16 |

FOREIGN PATENT DOCUMENTS 1002490 12/1976 Canada .

*Primary Examiner*—Benjamin R. Padgett
*Assistant Examiner*—Irwin Gluck
*Attorney, Agent, or Firm*—Vincent G. Gioia

[57] ABSTRACT

This invention relates to apparatus for forming a gaseous mixture comprising a carrier gas substantially saturated with vapors of a normally liquid chemical material, under conditions of high throughput. The apparatus of the invention is adapted to pass a carrier gas through a normally liquid chemical material in a pressure vessel, while controlling the temperature and pressure of the system, thereby controlling the concentration of the vaporous, normally liquid chemical material in the carrier gas and to assure the formation of a substantially saturated gaseous mixture. Before exiting the pressure vessel the initial dispersion of carrier gas and chemical material is contacted with means adapted to retard passage of liquid chemical substance from the pressure vessel and to enhance the degree of saturation of the carrier gas. The invention is also directed to the use of a gaseous mixture of curing agent and carrier gas to cure low temperature curing sand molding compositions.

9 Claims, 9 Drawing Figures

APPARATUS FORMATION OF GASEOUS MIXTURES AND METHOD OF USE

BACKGROUND OF THE INVENTION

Various methods for making foundry molds and cores are known. One preferred group of methods are known as cold box methods since these methods require relatively low curing temperatures for curing the binder resin used to bind together the foundry sand.

A particularly useful cold box method is the so called "Ashland" method. This method consists of mixing a resin which can be polymerized with an amine catalyst, such as triethylamine or dimethylethylamine with foundry sand. After the sand mixture is formed into the desired shape in an enclosed molding cavity, a gas to which the amine has been added is then injected into the molding cavity to cause the sand-resin mixture to harden by polymerization of the resin in the mixture.

While the above method has many advantages such as low cure temperature and fast production rates, the process is not without disadvantages. For example, the amine catalysts have a disagreeable odor and a sufficient level of toxicity so that it is necessary to avoid exposing operating personnel to the vapors. Fire and explosion risks are also significant. In addition proper, complete, and efficient distribution of the curing agent is frequently difficult to obtain.

Many catalyst systems now available operate by introducing a liquid phase catalyst into a carrier gas stream, either by bubbling the carrier gas through a tank of liquid, or by injecting the liquid directly into a carrier gas stream. Problems associated with these systems include lack of control over catalyst concentration in the carrier gas, and the likelihood of introducing the catalyst into the curable mixture as a mist or fog. Varying catalyst concentration results in uneconomical processing, since the gassing portion of the cure cycle must be established by the lowest concentration expected. Gassing with higher concentration than necessary merely wastes catalyst and carrier gas. In addition, admission of catalyst as a fog or mist into contact with the formed curable mixture causes the need for longer purge times and also hinders complete penetration and uniform cure of the formed sand-binder mixture. In addition, the presence of liquid phase catalyst which may collect in the delivery system presents numerous problems.

BRIEF DESCRIPTION OF THE INVENTION

This invention relates to apparatus for forming a gaseous mixture comprising a carrier gas substantially saturated with vapors of a normally liquid chemical material, under conditions of high throughput. The apparatus of the invention is adapted to pass a carrier gas through a normally liquid chemical material in a pressure vessel, while controlling the temperature and pressure of the system, thereby controlling the concentration of the vapors of, normally liquid chemical material in the carrier gas and to assure the formation of a substantially saturated gaseous mixture. Before exiting the pressure vessel, the initial dispersion of carrier gas and chemical material is contacted with means adapted to retard passage of liquid chemical substance from the pressure vessel and to enhance the degree of saturation of the carrier gas. The invention is also directed to the use of a gaseous mixture of curing agent and carrier gas to cure low temperature curing said molding compositions.

DETAILED DESCRIPTION OF THE INVENTION

Figure 1:
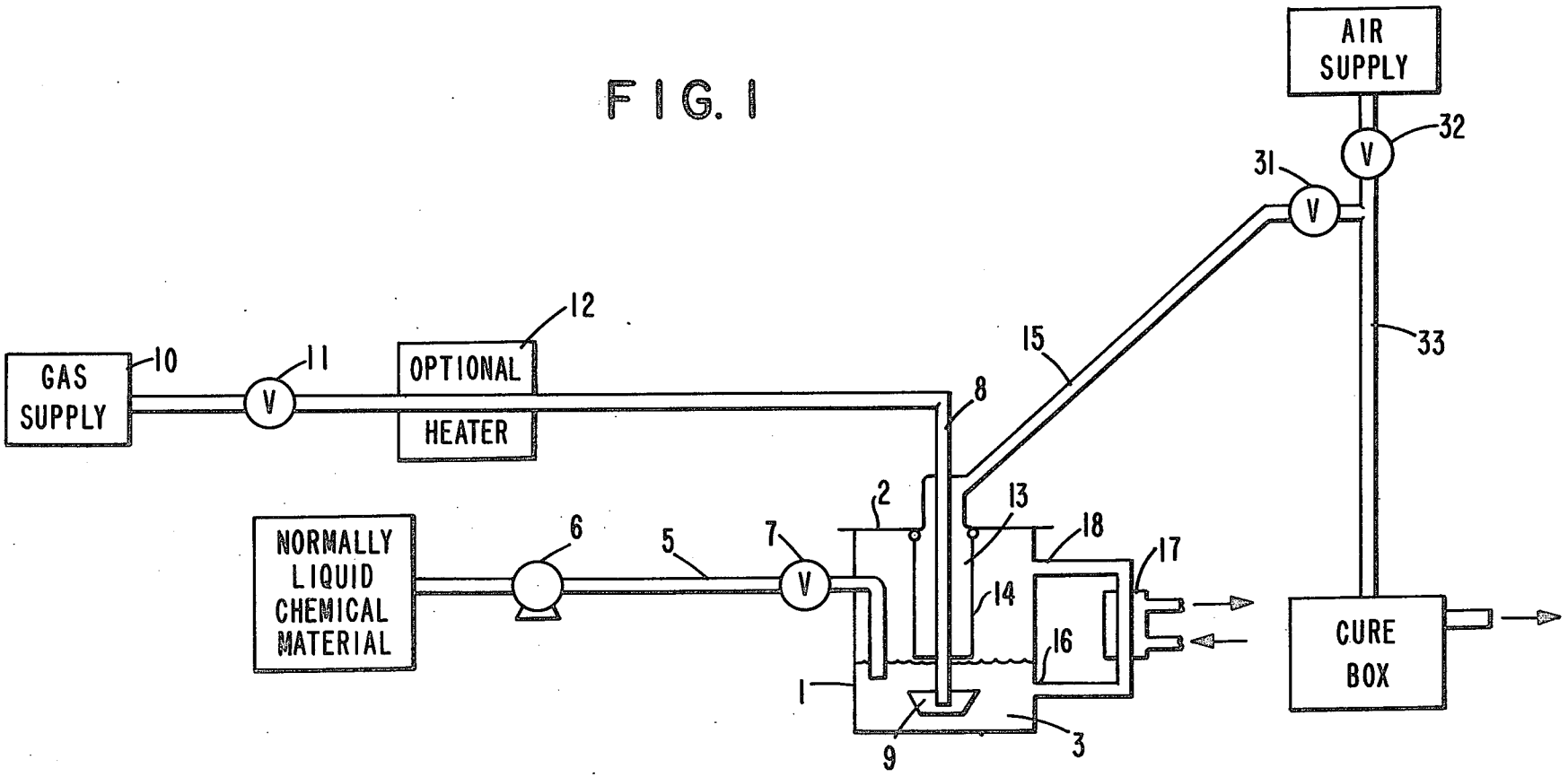
FIG. 1 is a schematic representation of the apparatus of the invention in association with a foundry mold system.
Figure 2:
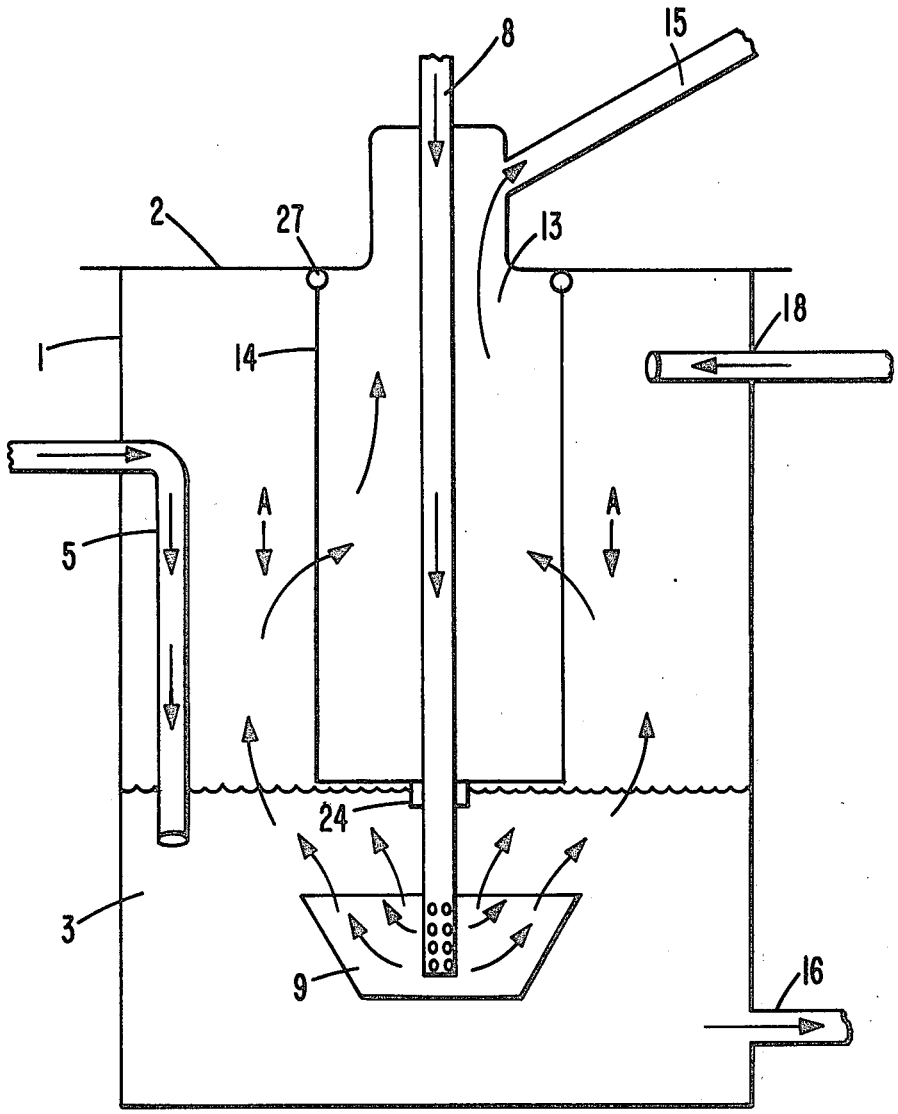
FIG. 2 is a schematic representation of the principal portions of the apparatus.

Referring to FIGS. 1 and 2, the apparatus of the invention which is adapted to provide a gaseous mixture of a carrier gas substantially saturated with vapors of a normally liquid chemical material comprises a tank 1, having secured thereon a detectable cover 2, into which is placed a normally liquid chemical material 3, in an amount sufficient to partially fill the tank, usually about $\frac{1}{3}$ the height of the tank. A demand supply of the normally liquid chemical material is provided from a container 4, through conduit means 5 into the tank, preferably introducing the liquid below the liquid level in the tank to maintain a desired quantity of liquid in the tank. Conduit means 5 is provided with pump means 6 and valve means 7, operably associated with a liquid level sensing device in the tank, such as a float (not shown). The tank is provided with conduit means 8 adapted to introduce carrier gas at a predetermined pressure into the tank through a dispersing means 9, located below the liquid level in the tank. The carrier gas is provided by a pressurized gas supply 10 connected to conduit 8 and controlled by valve means 11. If desired, the carrier gas can be heated before its introduction into the tank by means of a heater 12. The interior of the tank is provided with a chamber 13 located above the level occupied by the liquid and sealed from fluid communication from the tank, for example by gasket 27 and collar 24, except through a porous gas permeable surface portion 14, formed from a material wettable by the liquid and adapted to retard the exit of gas-entrained liquid from the tank, while providing intimate contact of the exiting gaseous mixture with normally liquid chemical material retained thereon. The interior of the chamber is connected to an outlet 15, through which the product gaseous mixture is withdrawn from the tank. The apparatus is provided with means adapted to control the temperature of the exiting gaseous mixture. Temperature control can be achieved by a single means or a combination of means, as shown, liquid is withdrawn from outlet 16 and pumped through a heat exchanger 17, for example a hot water heat exchanger, and returned to the tank through inlet 18.

Preferably, inlet 18 is so arranged that the returning liquid wets the gas permeable surface portion 14 with a spray of the liquid, thus enhancing gas-liquid contact.

Alternative means of temperature control include the use of a heat exchange tank jacket, or internal immersion heaters. The carrier gas and/or the liquid can be heated by suitable means before introduction into the tank.

A number of photographs are attached hereto and made a part hereof and are marked with Appendix numbers.

Appendix 1 shows the gas conduit 8 with holes about its base to deliver large gas volumes to the dispensing means 9. Note the base of chamber 13 at the top of the photograph.

Appendix 2 shows a preferred dispensing means or sparger 9, which comprises a generally circular box having solid side and bottom portions and a top surface which comprises a screen adapted to disrupt the gas flow from conduit 8 into small bubbles to provide a large gas liquid interface. The sparger bottom has a several small holes to allow for the exit of sludge or particulate material which, if present, might otherwise collect in the sparger.

Appendix 3 shows the sparger in place at the base of the conduit 8. Note the base of the chamber 13 at the top of the photo, as well as the liquid level sensing float mechanism attached thereto, which signals the need for make-up liquid.

Appendix 4 shows the chamber 13, with layers of a stainless steel wire mesh screen serving as the gas permeable surface portion 14.

Appendix 5 shows the chamber 13 in its operable position, fastened about gas conduit 8, and sealed against the top of the tank and against the gas conduit.

Appendices 6 and 7 are overall views of an actual operable installation.

Figure 3:
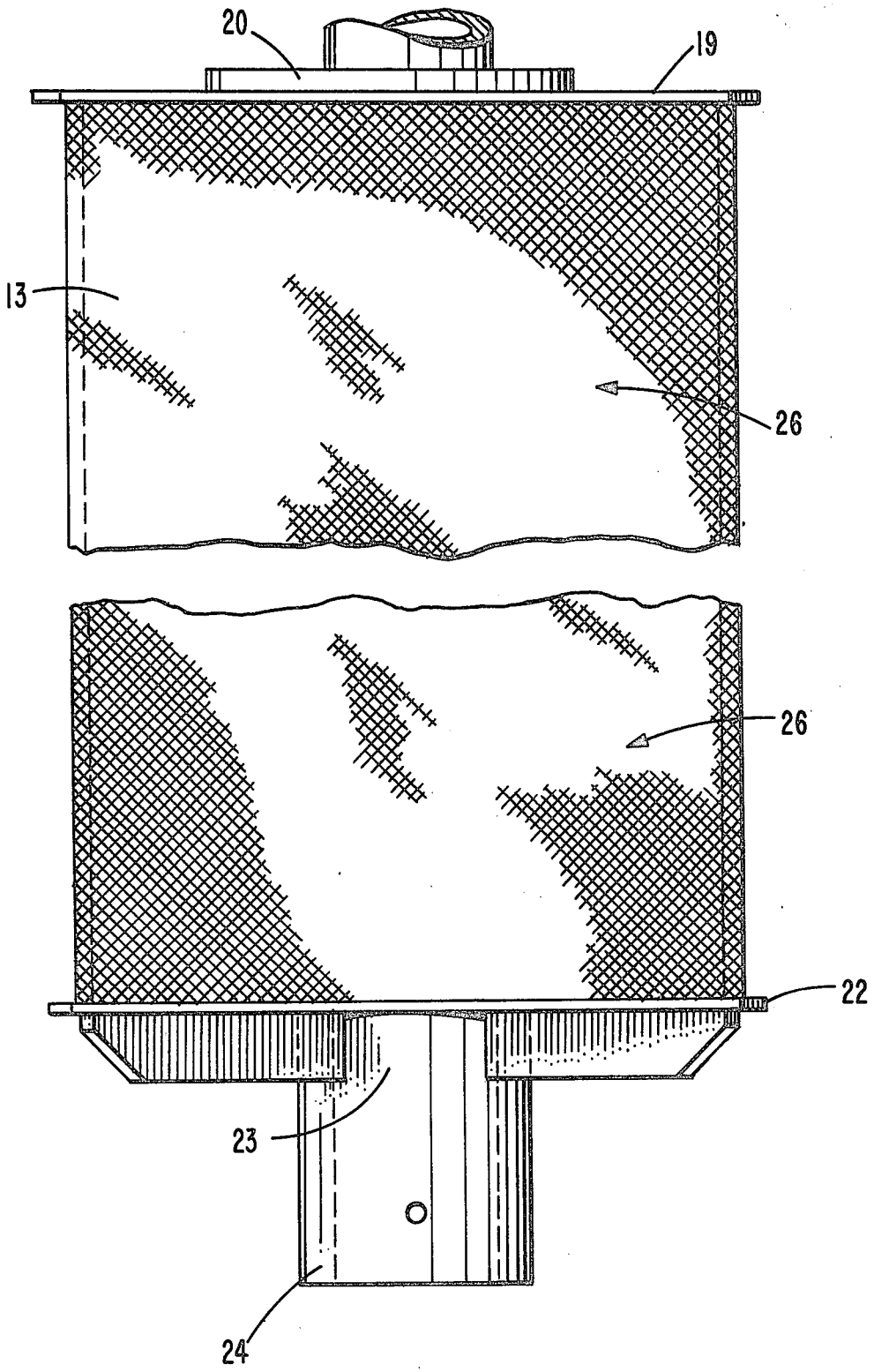
FIG. 3 is a representation of the chamber adapted to enhance the quality of the product gas mixture.
Figure 4:
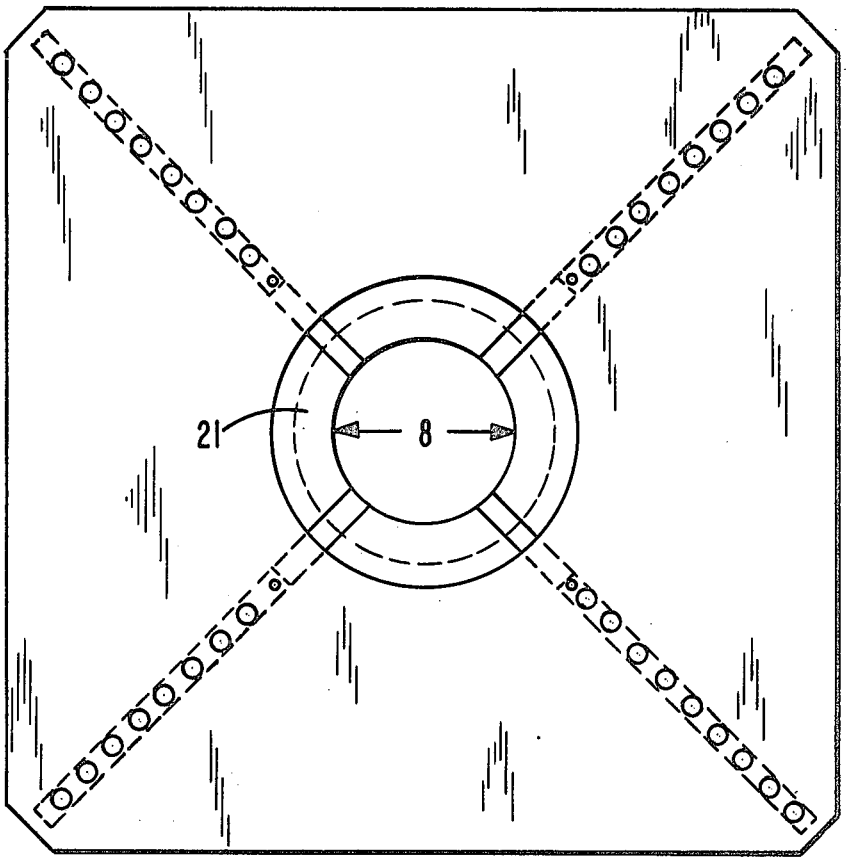
FIG. 4 is a representation of a top view of the chamber shown in FIG. 3.
Figure 5:
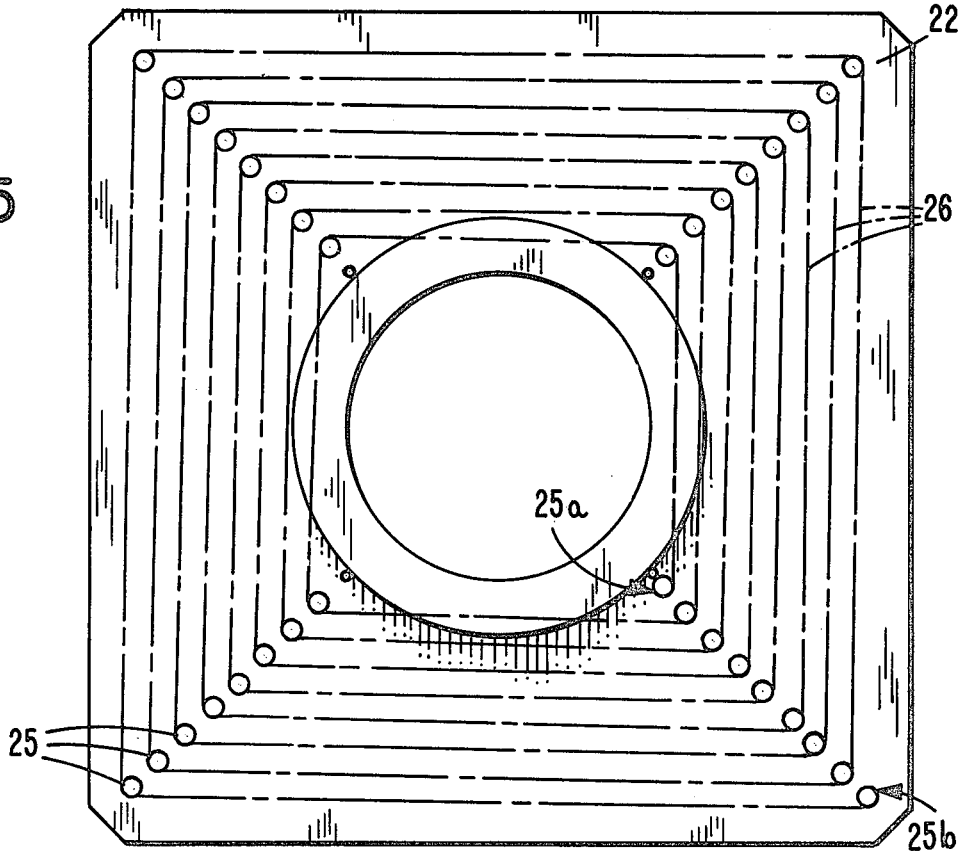
FIG. 5 is a representation of a top cross-section view of the chamber shown in FIG. 3.

With reference to FIGS. 3, 4 and 5, a preferred construction of chamber 13 comprises a solid top plate having an opening 20 which allows for the passage of conduit 8 therethrough, while providing the annular opening 21, about conduit 8, to allow exiting of the product gas mixture; and a solid bottom plate provided with an opening 23 corresponding to the dimensions of the outer diameter of conduit 8, and a collar 24 to provide a substantially liquid tight slip fit about conduit 8. Substantially perpendicular to the top and engaged with the top and bottom plates are a series of supports, e.g. rods 25, adapted to support and space apart plural layers of screening 26, which comprise the side portions of the chamber. The screening is fastened to the support, at least at supports **25*a* and 25*b***, the beginning and end of the depicted spirally wound screen. As an alternative to the spiral configuration, spaced apart coaxially nested box or cyclindrical sections or the like can be employed to provide the plural layers of screening material.

In operation it is theorized that the plural layers of screening operate to intercept liquid droplets entrained in the gas flowing through the screen. The screen is wetted by the droplets and thus provide a large gas-liquid contact area to enhance the degree of vapor saturation of the carrier gas passing through the screening. In a preferred embodiment 20×20/inch (wire size 0.016) stainless steel wire, in about eight spaced apart, spirally wound layers was employed.

Note that FIG. 5 can be considered a top section view along the line A—A in FIG. 2.

It is preferred that the conduits, such as 15, carrying the product gas mixture are sloped toward the tank 6 so that any entrained or condensed liquid is returned by gravity to the tank through outlet conduit 15.

In operation it is desirable to heat the product gas conduits, for example to about 5°–10° C. above the product gas temperature to reduce the incidence of liquid in the product gas at time of use. Under these conditions it is noted that even when a small amount of liquid is noted in the product gas conduit immediately upon exit from the tank, if the product gas conduit is of any appreciable length the product gas, upon delivery to a use station is essentially liquid free.

The materials of construction employed to fashion the apparatus are dictated in part by the particular liquid vaporized and the temperatures and pressures employed. When handling amines typical stainless steel and fluorocarbon polymer (Telfon) gaskets and seals are adequate.

In the process of the invention a carrier gas, relatively chemically inert with respect to the normally liquid chemical material such as nitrogen, carbon dioxide, or even air is passed through a pressure regulator into the tank. The tank is partially filled with a normally liquid chemical material. The carrier gas is distributed below the surface of the liquid causing the carrier gas to become appreciably saturated with vapor of the normally liquid material. The temperature of the tank contents are controlled to provide a predetermined exit gas temperature. As the level of the liquid is reduced by volitization, the liquid level is maintained by adding more liquid. Before exiting the tank, since the gas throughput is high, for example in excess of 50 standard cubic feet per hour, the residence time tends to be less than that which could be expected to readily achieve vapor-liquid equilibrium, based upon the degree of gas dispersion which can be practically achieved and maintained; in addition the high throughputs cause liquid droplet entrainment which is undesirable where a gaseous product stream is desired. To deal with both these problems, before exiting the tank the exiting gas is passed through a gas permeable means which is adapted to retard the exit entrained liquid from the tank, while providing intimate contact of the exiting gaseous mixture with the normally liquid chemical material retained thereon.

A very significant use of the method and apparatus of this invention is to provide vaporized volatile normally liquid amines, for example, triethylamine (TEA), to a foundry mold or core molding process using amine curable binder resins, e.g. the so-called "Ashland Process". In this regard the following discussion relates to TEA, but the information is generally applicable to other vaporizable normally liquid chemical materials.

Table I illustrates the effects of temperature upon the density and partial pressure of pure saturated TEA vapor. The pure TEA densities and partial pressures are not seriously affected by the presence of other gases, provided that any other gases present are chemically inert with respect to the TEA and also saturated with TEA vapor. In the table, densities (in grams/liter and pounds/cubic foot) and partial pressures (in torr) are tabulated for temperatures in the range between 0.0° and 100.0° C. Graphical interpolation may be used to estimate densities or pressures at temperatures other than those listed.

Table I may be used as an aid in calculating the mass flow rate of TEA which may be delivered through a pipeline by an inert carrier gas saturated with TEA vapor. For example, an inert gas saturated with TEA vapor, at 50.0° C., is capable of carrying 0.939 grams of TEA per liter of inert gas/TEA mixture. Thus, if the flow rate of the inert gas/TEA mixture is 10.0 liters per minute, then the mass flow rate of the TEA is 9.39 grams per minute (0.939 g/l * 10.0 l/min=9.39 g/min). If an inert gas TEA mixture, at the same temperature and flow rate as above, was only 90% saturated with TEA, then the mass flow rate of the TEA would have been 8.45 grams per minute (0.90* 0.939 g/l * 10.0 l/min=8.45 g/min).

The mass of TEA which may be carried per liter of inert gas/TEA mixture is, for all practical purposes, independent of the partial pressure of the inert gas. It depends only upon the temperature of the saturated inert gas/TEA mixture. The most economical use of an inert carrier gas for the TEA may be realized at the highest practical saturation temperature and the lowest practical inert gas partial pressure. The highest practical saturation temperature and lowest practical inert gas pressure must be determined experimentally since other factors related to the end use of the inert gas/TEA mixture may dictate optimal operating conditions.

TABLE I

TEMPERATURE/DENSITY/PRESSURE RELATIONSHIPS FOR PURE SATURATED TEA VAPOR

| TEMP (DEG C) | DENSITY (GM/L) | DENSITY (LB/FT3) | PRESSURE (TORR) |
|---|---|---|---|
| 0. | .086 | .0054 | 14.5 |
| 5.0 | .115 | .0072 | 19.8 |
| 10.0 | .152 | .0095 | 26.6 |
| 15.0 | .199 | .0124 | 35.3 |
| 20.0 | .256 | .0160 | 46.2 |
| 25.0 | .326 | .0203 | 59.8 |
| 30.0 | .410 | .0256 | 76.6 |
| 35.0 | .511 | .0319 | 97.1 |
| 40.0 | .632 | .0394 | 121.9 |
| 45.0 | .773 | .0433 | 151.6 |
| 50.0 | .939 | .0586 | 187.0 |
| 55.0 | 1.131 | .0706 | 228.8 |
| 60.0 | 1.353 | .0845 | 277.8 |
| 65.0 | 1.607 | .1003 | 334.9 |
| 76.0 | 1.896 | .1184 | 401.0 |
| 75.0 | 2.223 | .1388 | 477.0 |
| 80.0 | 2.591 | .1618 | 564.0 |
| 85.0 | 3.004 | .1876 | 663.1 |
| 90.0 | 3.464 | .2163 | 775.3 |
| 95.0 | 3.974 | .2481 | 901.7 |
| 100.0 | 4.538 | .2833 | 1043.6 |

Figure 6:
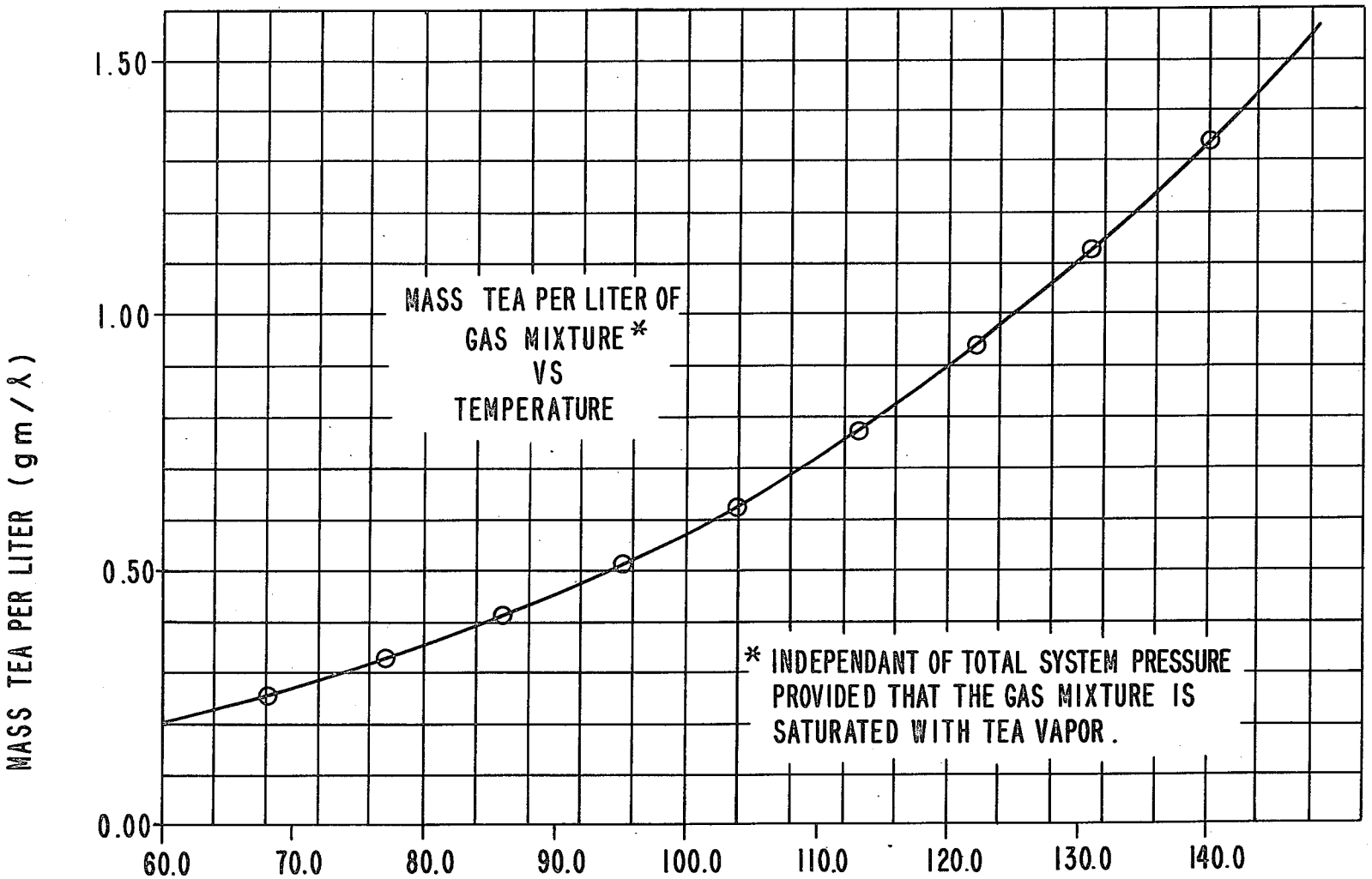
FIG. 6 is a graphical presentation of data such as set forth in Table I.

FIG. 6 is a graphic presentation of a portion of the data contained in Table I.

Table II illustrates the effects of pressure and temperature upon the weight and volume percentage of TEA in nitrogen or carbon dioxide gas saturated with TEA vapor. Weight and volume percentages have been tabulated at pressures and temperatures ranging between 15.0–30.1 psia and 20.0°–90.0° C. All pressures are sums of the partial pressure of saturated TEA vapor, at the temperature of interest, and the partial pressure of either nitrogen or carbon dioxide gas. Since the volume percentage of TEA in either nitrogen or carbon dioxide is the same at any specific pressure and temperature, there is only one column for volume percentages of TEA in either inert gas.

Table II may be used as an aid in calculating the volume or mass flow rate, of nitrogen or carbon dioxide gas, required to carry a specific amount of TEA vapor through a pipeline. For example, the volume percentage of TEA in an inert gas/TEA mixture, at 60.0° C. and a total pressure of 30.0 psia, is 17.9 percent. Therefore, if the flow rate of the inert gas/TEA mixture is 10.0 liters per minute, the flow rate of the inert gas above is about 8.2 liters per minute (10.0 l/min–0.1790 * 10.0 l/min=8.2 l/m). At this temperature, 1.353 grams of TEA vapor can be carried within each liter of the gas mixture.

TOTAL GAS PRESSURE = 15.0 PSIA

| TEMP (DEG C) | WEIGHT % (TEA/N2) | WEIGHT % (TEA/CO2) | VOLUME % (TEA/IG) |
|---|---|---|---|
| 20.0 | 18.62 | 12.71 | 5.96 |
| 25.0 | 23.19 | 16.12 | 7.71 |
| 30.0 | 28.36 | 20.12 | 9.88 |
| 35.0 | 34.08 | 24.76 | 12.52 |
| 40.0 | 40.25 | 30.00 | 15.71 |
| 45.0 | 46.75 | 35.84 | 19.55 |
| 50.0 | 53.44 | 42.21 | 24.11 |
| 55.0 | 60.18 | 49.03 | 29.50 |
| 60.0 | 66.84 | 56.20 | 35.81 |
| 65.0 | 73.30 | 63.59 | 43.17 |
| 70.0 | 79.45 | 71.10 | 51.60 |
| 75.0 | 85.23 | 78.60 | 61.49 |
| 80.0 | 90.59 | 85.97 | 72.71 |
| 85.0 | 95.51 | 93.12 | 85.48 |
| 90.0 | 99.98 | 99.97 | 99.94 |

TOTAL GAS PRESSURE = 20.0 PSIA

| TEMP (DEG C) | WEIGHT % (TEA/N2) | WEIGHT % (TEA/CO2) | VOLUME % (TEA/IG) |
|---|---|---|---|
| 20.0 | 14.45 | 9.70 | 4.47 |
| 25.0 | 18.15 | 12.37 | 5.78 |
| 30.0 | 22.42 | 15.53 | 7.41 |
| 35.0 | 27.23 | 19.24 | 9.39 |
| 40.0 | 32.55 | 23.50 | 11.78 |
| 45.0 | 38.29 | 28.31 | 14.66 |
| 50.0 | 44.36 | 33.66 | 18.08 |
| 55.0 | 50.64 | 39.50 | 22.12 |
| 60.0 | 57.01 | 45.77 | 26.86 |
| 65.0 | 63.36 | 52.40 | 32.37 |
| 70.0 | 69.57 | 59.27 | 38.76 |
| 75.0 | 75.56 | 66.30 | 46.11 |
| 80.0 | 81.24 | 73.38 | 54.52 |
| 85.0 | 86.58 | 80.41 | 64.10 |
| 90.0 | 91.53 | 87.30 | 74.94 |

TOTAL GAS PRESSURE = 25.0 PSIA

| TEMP (DEG C) | WEIGHT % (TEA/2) | WEIGHT % (TEA/CO2) | VOLUME % (TEA/IG) |
|---|---|---|---|
| 20.0 | 11.80 | 7.85 | 3.57 |
| 25.0 | 14.91 | 10.03 | 4.63 |
| 30.0 | 18.53 | 12.65 | 5.92 |
| 35.0 | 22.68 | 15.73 | 7.51 |
| 40.0 | 27.32 | 19.31 | 9.42 |
| 45.0 | 32.42 | 23.39 | 11.72 |
| 50.0 | 37.92 | 27.99 | 14.46 |
| 55.0 | 43.71 | 33.07 | 17.69 |
| 60.0 | 49.71 | 38.61 | 21.48 |
| 65.0 | 55.80 | 44.55 | 25.89 |
| 70.0 | 61.88 | 50.82 | 31.00 |
| 75.0 | 67.86 | 57.33 | 36.88 |
| 80.0 | 73.64 | 64.01 | 43.61 |
| 85.0 | 79.17 | 70.75 | 51.27 |
| 90.0 | 84.39 | 77.48 | 59.94 |

TOTAL GAS PRESSURE = 30.0 PSIA

| TEMP (DEG C) | WEIGHT % (TEA/N2) | WEIGHT % (TEA/CO2) | VOLUME % (TEA/IG) |
|---|---|---|---|
| 20.0 | 9.98 | 6.59 | 2.98 |
| 25.0 | 12.65 | 8.44 | 3.85 |
| 30.0 | 15.79 | 10.66 | 4.94 |
| 35.0 | 19.42 | 13.30 | 6.26 |
| 40.0 | 23.54 | 16.38 | 7.85 |
| 45.0 | 28.11 | 19.93 | 9.77 |
| 50.0 | 33.10 | 23.95 | 12.05 |

-continued

| TOTAL GAS PRESSURE = 30.0 PSIA | | | |
|---|---|---|---|
| TEMP (DEG C) | WEIGHT % (TEA/N2) | WEIGHT % (TEA/CO2) | VOLUME % (TEA/IG) |
| 55.0 | 38.45 | 28.44 | 14.74 |
| 60.0 | 44.06 | 33.39 | 17.90 |
| 65.0 | 49.85 | 38.75 | 21.57 |
| 70.0 | 55.72 | 44.47 | 25.83 |
| 75.0 | 61.58 | 50.50 | 30.73 |
| 80.0 | 67.34 | 56.75 | 36.34 |
| 85.0 | 72.93 | 63.16 | 42.72 |
| 90.0 | 78.28 | 69.64 | 49.94 |

| | | LB. | OLD INJECTION PROCESS | | | | PROCESS OF THE INVENTION | | | | | | |
|---|---|---|---|---|---|---|---|---|---|---|---|---|---|
| | | SAND | CALCULATED TEA NEEDED | | ACTUAL TEA USED | | $N_2$ | GASS-ING | | | VOL %) | TEA USED | % LESS |
| CORE WT. LB. | # CORES MADE | CURED $10^3$ lbs. | C.C. | LB. TEA TON | C.C. | LB. TEA TON | USED FT.$^3$ | TIME SEC. | TEMP. °F. | PRESS. PSIA | TEA % | LB. TEA TON | TEA % |
| 50.1 | 466 | 23.3 | | | 80 | 5.14 | 85 | 4.5 | 140 | 60 | 8.95 | .19 | 96.26 |
| 0.1 | 54 | 2.7 | | | 80 | 5.14 | 14 | 5.2 | 122 | 60 | 6.03 | .18 | 96.59 |
| 0.1 | 246 | 12.3 | | | 80 | 5.14 | 63 | 5.75 | 113 | 60 | 4.89 | .14 | 97.29 |
| 167 | 103 | 17.2 | 40 | 0.77 | 120 | 2.31 | 114 | 13.0 | 122 | 60 | 6.03 | .23 | 90.17 |
| 128 | 110 | 14.0 | 35 | 0.88 | 80 | 2.01 | 56 | 5.25 | 113 | 70 | 4.19 | .09 | 95.38 |
| 119.5 | 37 | 4.4 | 40 | 1.08 | 80 | 2.16 | 16.6 | 5.0 | 113 | 60 | 4.89 | .10 | 95.23 |
| 141 | 126 | 17.7 | 40 | 0.913 | 80 | 1.83 | 117.5 | 12.0 | 113 | 50 | 5.86 | .22 | 87.98 |
| 30.25 | 167 | 5.0 | 20 | 2.13 | 80 | 8.52 | 28.3 | 1.4 | 113 | 80 | 3.67 | .11 | 98.66 |
| 50.1 | 384 | 19.2 | | | 80 | 5.14 | 149 | 8.0 | 113 | 80 | 3.67 | .16 | 96.95 |
| 107.5 | 93 | 9.9 | 35 | 1.05 | 80 | 2.40 | 33 | 4.0 | 134 | 50 | 9.61 | .19 | 92.25 |
| 8.5 | 52 | 7.7 | 35 | 0.76 | 80 | 1.73 | 21 | 7.0 | 134 | 45 | 10.81 | .18 | 89.88 |
| 148.5 | 144 | 21.3 | 35 | 0.76 | 80 | 1.73 | 67 | 6.0 | 134 | 50 | 9.61 | .18 | 89.88 |
| 82 | 40 | 3.2 | 25 | 0.98 | 80 | 3.14 | 23 | 6.0 | 134 | 50 | 9.61 | .39 | 87.60 |
| 154.5 | 67 | 10.3 | 40 | 0.83 | 80 | 1.67 | 24 | 4.5 | 134 | 50 | 9.61 | .13 | 92.27 |
| 60.5 | 260 | 15.7 | | | 80 | 2.13 | 27 | 3.5 | 132 | 50 | 9.04 | .10 | 95.35 |
| 93.5 | 114 | 10.6 | 25 | 0.86 | 80 | 2.76 | 38 | 4.5 | 132 | 50 | 9.04 | .19 | 93.01 |
| 61.5 | 49 | 3.0 | 23 | 1.20 | 80 | 4.19 | 12 | 3.0 | 134 | 50 | 9.61 | .23 | 94.56 |

Figure 7:
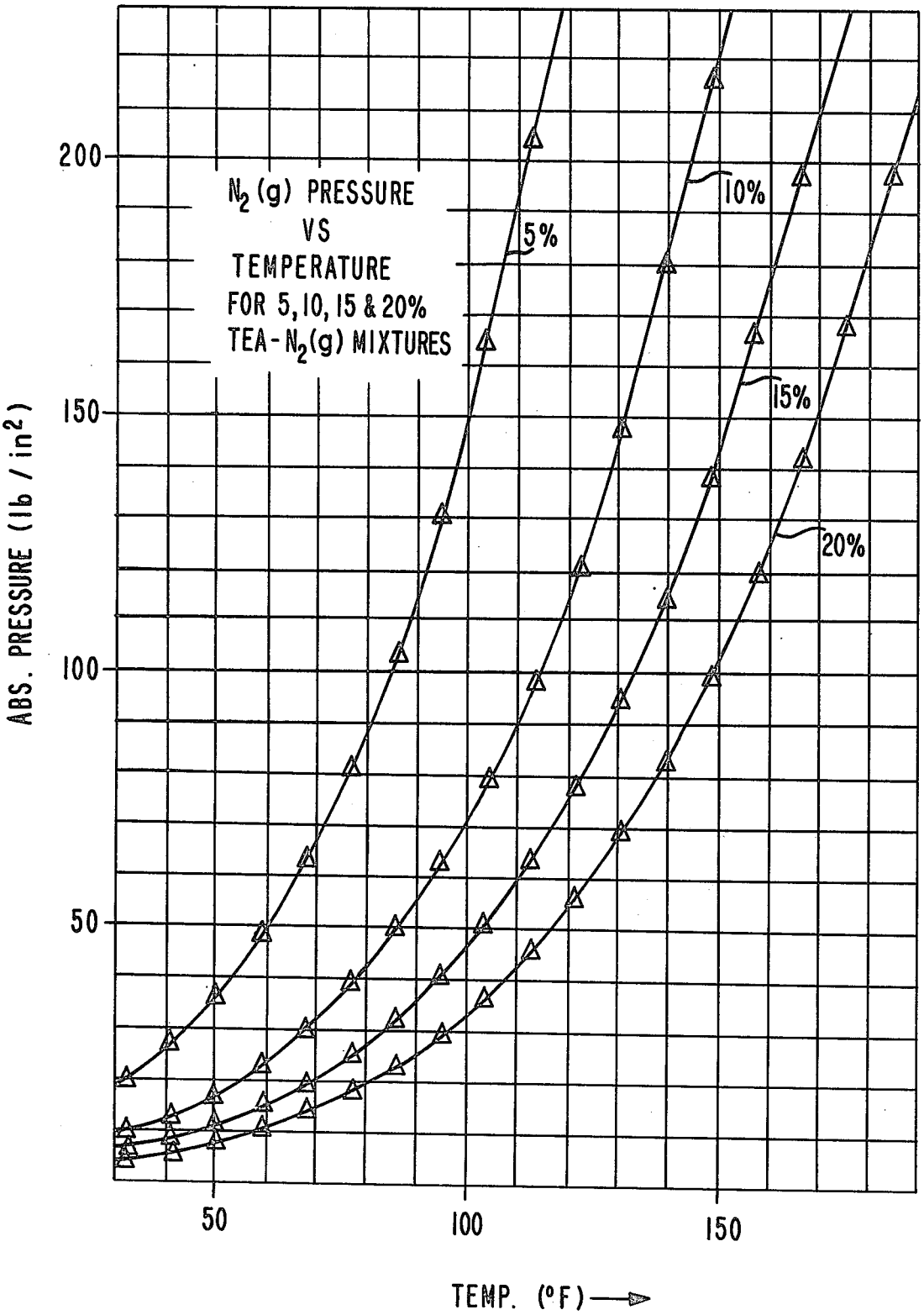
FIGS. 7 and 8 are graphical presentations of data similar to that contained in Table II.
Figure 8:
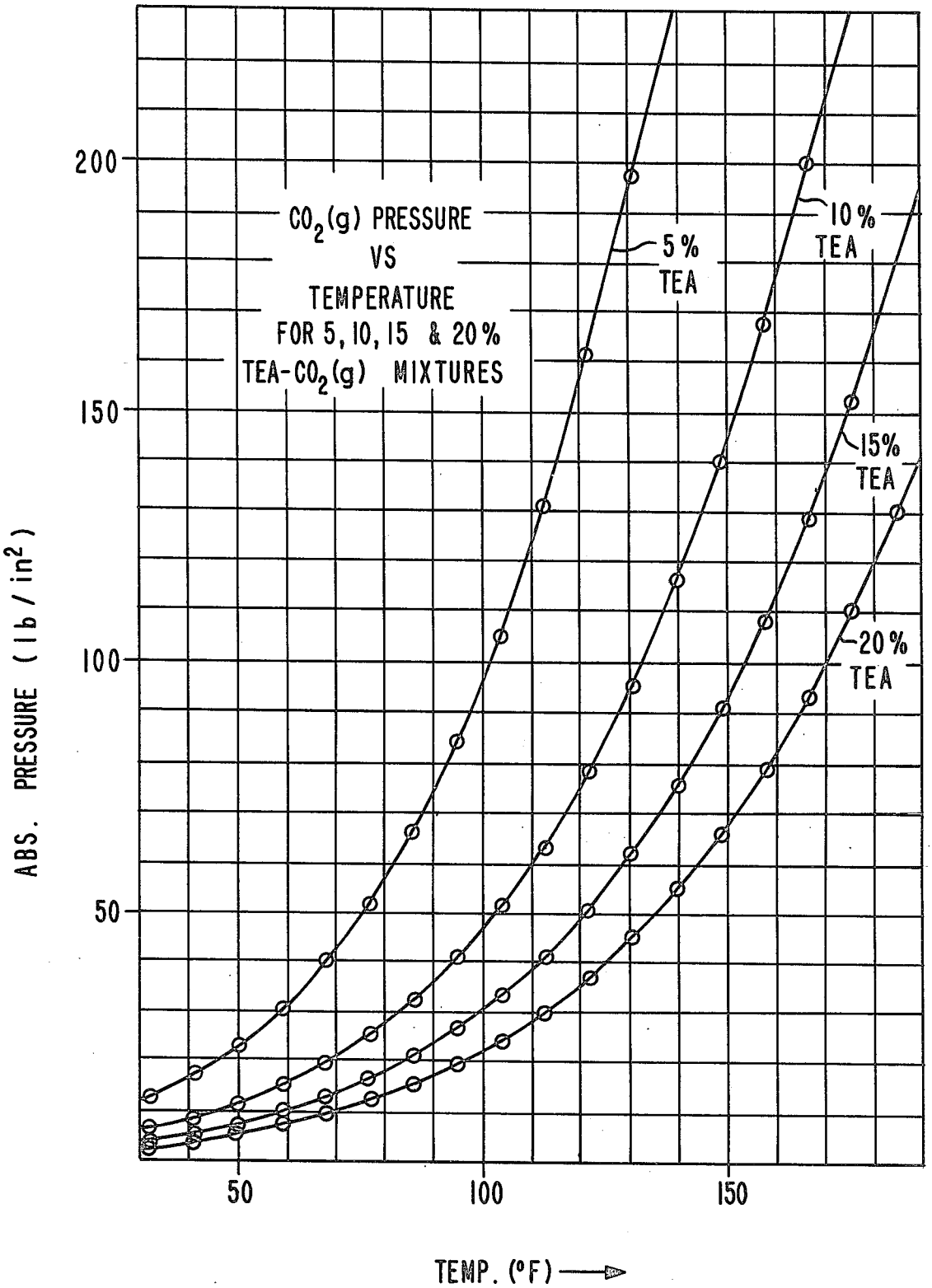

In a similar manner additional Tables for varying gas pressures and temperatures can readily be generated. FIGS. 7 and 8 are graphical representations of data similar to that contained in Table II.

Figure 9:
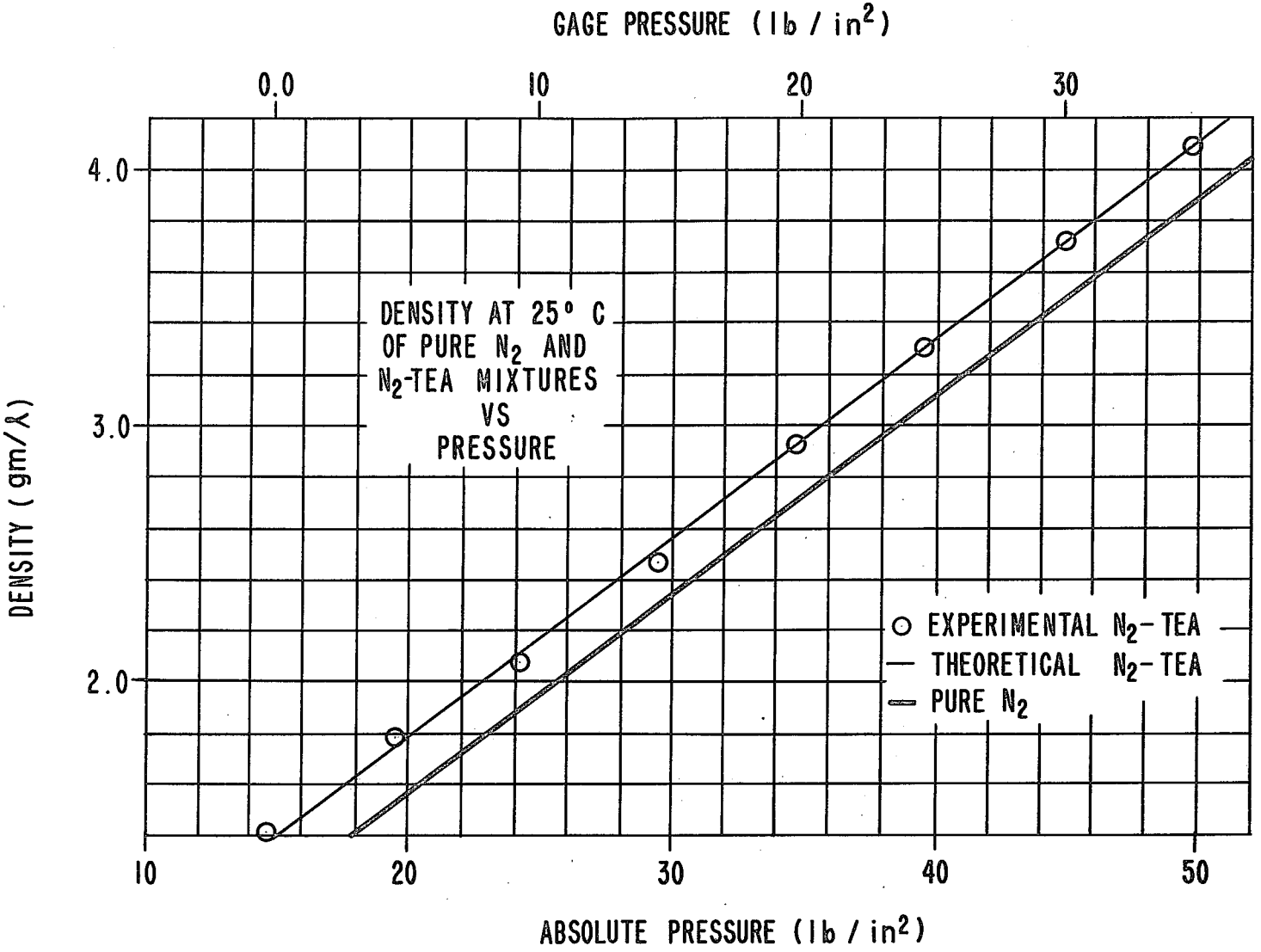
FIG. 9 is a graphical presentation which shows the correlation of experimental data with theoretical data.

FIG. 9 shows a graphic presentation of laboratory results which show that the degree of saturation achieved by the apparatus and process of the invention is very close to the theoretical saturation values.

EXAMPLE

The apparatus and process of the invention have been tested in an actual foundry core curing process. The data presented below shows a large excess of amine (TEA) employed in the former injection process, which employed state of the art technology to inject and atomize the amine by use of a piston driven injector.

Because of inefficiencies in the vaporization of amines (injected by the piston driven injector) and practical difficulties associated with adjustments in piston strokes (to accurately control the quantity of amine injected to case varying sizes of cores), the direct liquid injection method involved considerable waste of liquid amine.

The apparatus of the invention tested had a tank about six feet high and two feet in diameter containing about two feet of amine. The sparger, located almost at the bottom of the tank, had a top surface 19 inches in diameter, 30% open with 1/16 inch holes and was fed by a 2 inch pipe closed at the bottom and containing a plurality of holes, with a surface area 2–3 times the pipe cross-sectional area, opening into the interior of the sparger. The gas permeable chamber was constructed as shown in FIGS. 3 thru 5 with 20×20/inch (wire size 0.016) screen in light layers, the screen surface was four feet high and the spiral winding was 19 feet long with the spacing between layers being about ½ inch.

A number of runs were made using both the prior are liquid injection process and the process of the invention. With reference to FIG. 1, with valve 31 open and valve 32 closed, the TEA saturated carrier gas produced in the apparatus of the invention was passed through a conventional cure box at the stated pressure, for the stated gassing time, valve 31 is then closed and valve 32 opened to flush the cure box with air through line 33 at 15 psig for 30 to 40 seconds. In each case the resultant molding was satisfactorily cured.

A marked advantage of the apparatus and process of the invention is the ability to delivery saturated carrier gas to a large number of use stations from a central location, this is of particular importance when the normally liquid chemical material is flammable and/or toxic. Since the amount of chemical material in the gas can be made constant and predictable, the quantity employed at any particular use station can be controlled by merely controlling time and pressure. Since the main distribution lines can be operated at a higher pressure than that required at a use station, the pressure at the use station can be made constant by a pressure reduction valve and therefore time becomes the only variable which must be manipulated at a use station to achieve a desired result.

While the above discussion has principally exemplied TEA the nature of the normally liquid chemical material is not unduly critical. The chemical material can be chemical element, e.g. bromine, an organic or inorganic compound including polymeric materials or a chemical mixture or complex.

While the invention above has been particularly exemplified, the invention can be otherwise practiced with the scope of the disclosure to achieve similar results with the scope of the appended claims. All temperatures are °C. unless otherwise specified and all percentages are by weight unless otherwise specified.

I claim:

1. A method for substantially saturating a carrier gas with a predetermined concentration of vapors of a normally liquid chemical material which comprises:

(a) passing a dispersion of a carrier gas at a predetermined pressure through a normally liquid chemical material at a predetermined temperature; and then (b) passing the resultant carrier gas associated with a portion of said liquid through a gas permeable means, wettable by said liquid, which retards the passage of the associated liquid, while providing intimate contact of the carrier gas with liquid retained on the gas permeable means;

(c) thereby producing a product gas mixture comprising said carrier gas substantially saturated with vapors of said liquid.

2. The method of claim 1 where the liquid is a volatile amine foundry mold curing agent.

3. The method of claim 1 wherein the liquid is sprayed against the gas permeable means.

4. The method of claim 3 wherein the liquid is heated before it is sprayed thereagainst.

5. The method of claim 1 wherein the mixture thus produced is conducted to a point where said mixture is to be used through a conduit that is heated to reduce the incidence of any liquid in the conduit.

6. The method of claim 5 wherein the conduit is heated to about 5°–10° C. above the temperature of said mixture.

7. The method of claim 1 wherein the mixture thus produced is conducted to a point where said mixture is to be used through a conduit that is sloped so that any liquid in the conduit is returned.

8. The method of claim 7 wherein the conduit is heated to reduce the incidence of any liquid in the conduit.

9. The method of claim 8 wherein the conduit is heated to about 5°–10° C. above the temperature of said mixture.

* * * * *